US007523970B2

(12) United States Patent
Konchan

(10) Patent No.: US 7,523,970 B2
(45) Date of Patent: Apr. 28, 2009

(54) TRUNK EMERGENCY RELEASE HANDLE HAVING A LUMINOUS INSERT

(75) Inventor: Jeffrey L. Konchan, Romeo, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 6 days.

(21) Appl. No.: 11/688,471

(22) Filed: Mar. 20, 2007

(65) Prior Publication Data

US 2008/0231062 A1 Sep. 25, 2008

(51) Int. Cl.
*E05B 1/00* (2006.01)

(52) U.S. Cl. ..... 292/347; 292/336.3; 292/DIG. 43

(58) Field of Classification Search ..... 292/336.3, 292/DIG. 43, 347; 362/501; 40/542, 543, 40/549; 264/21

See application file for complete search history.

(56) References Cited

U.S. PATENT DOCUMENTS 2,125,780 A * 8/1938 Goggin ..... 40/542
2,654,971 A 10/1953 Harrison
3,404,474 A * 10/1968 Johnson ..... 40/544
3,929,294 A * 12/1975 Cox ..... 241/101.76
5,339,550 A * 8/1994 Hoffman ..... 40/544
5,557,869 A * 9/1996 Douglas ..... 40/542
6,209,933 B1 * 4/2001 Ang et al. ..... 292/336.3
6,369,395 B1 4/2002 Roessler
6,394,511 B1 5/2002 Lam et al.
6,527,313 B2 * 3/2003 Takahashi et al. ..... 292/336.3
6,932,486 B1 * 8/2005 Eller et al. ..... 362/100
7,029,138 B2 4/2006 Tibbenham et al.

* cited by examiner

*Primary Examiner*—Gary Estremsky

(57) ABSTRACT

A trunk emergency release handle composed of an exterior shell of preferably opaque plastic material having an instructional pictorial representation in the form of iconic holes conveying purpose and use information of the handle. In one form, a luminous insert is received into a slot of the exterior shell so as to be located at the iconic holes and thereby provide illumination thereof. In a second form, the luminous material is co-molded with the opaque plastic in a two-shot injection molding process.

15 Claims, 5 Drawing Sheets

TRUNK EMERGENCY RELEASE HANDLE HAVING A LUMINOUS INSERT

TECHNICAL FIELD

The present invention relates to emergency release handles which are connected to a decklid latch mechanism by which a person trapped in the trunk of an automobile may pull thereupon in order to gain extrication. More particularly, the present invention relates to a trunk emergency release handle composed of an opaque plastic material having an instructional pictorial representation in the form of iconic holes, wherein a luminous insert provides illumination of the iconic holes.

BACKGROUND OF THE INVENTION

The hinged decklid of an automobile selectively encloses the trunk thereof and incorporates a decklid latch mechanism which retains the decklid in a locked, closed position until being selectively unlocked via exterior insertion of a key or, optionally, by an electronic actuator of the decklid latch mechanism activated by a remote transmitter and/or button situated in the passenger compartment.

Decklid latch mechanisms which further provide an internal manual actuation device having a trunk emergency release handle situated within the trunk are well known in the art, as for example described in U.S. Pat. Nos. 6,394,511 B1 and 6,369,395 B1. These systems are intended to be used by an individual who has untowardly become trapped in the trunk because the decklid has become locked in the closed position while the person is thereinside.

To gain his/her release from confinement within the trunk, this entrapped individual must become aware of the presence of the trunk emergency release handle and the mode by which it is manually used to actuate the decklid latch mechanism—which awareness likely will only first occur at the commencement of the individual's untoward confinement. In order to render this awareness readily available and intuitively obvious even to a young child, in the prior art two aspects of a trunk emergency release handle have been developed: 1) a pictorial representation from which an onlooker can readily apprehend the purpose and use of the emergency release handle; and 2) an illumination of the pictorial representation, in that a closed decklid renders the interior space of the trunk dark even in daylight.

An example of a luminous pictorialized trunk emergency release handle is utilized by General Motors Corporation of Detroit, Mich., on certain of its vehicles at least as early as 2001, shown at FIGS. 1A and 1B. An automobile 10 has a trunk 12 having an interior space 14. A hinged decklid 16 is pivotable between an open position (as shown) to a closed position, wherein the interior space 14 is completely enclosed. A decklid latch mechanism 18, including a first latch component 18*a* on the decklid and a second latch component 18*b* at a sidewall 12*a* of the trunk, wherein when the decklid is at its closed position, it is locked closed by the decklid latch mechanism (see for example the decklid latch mechanism described in U.S. Pat. No. 6,394,511 B1), wherein a trunk emergency release handle 20 is connected thereto by a cable linkage 22. The trunk emergency release handle is T-shaped and composed of a luminous material, as for example a phosphorescent material, wherein a pictorial representation 24 is provided thereupon, as for example by pad printing (see FIG. 1B). The pictorial representation 24 is, for example, that of an automobile with an open trunk 24*a*, a caricature of a person in an exiting mode of movement 24*b*, and an arrow 24*c* showing how to pull on the trunk emergency release handle to operate the decklid latch mechanism to thereby secure release. This pictorial representation 24 is suited to inform a small child of what to do to secure his/her release from the confined space of the trunk.

A second example of a trunk emergency release handle is described in U.S. Pat. No. 7,029,238 B2, which discloses a trunk emergency release handle of T-shape, having a pictorial representation of an automobile with an open trunk, a caricature of a person in an exiting mode of movement, and an arrow showing how to pull on the trunk emergency release handle to operate the decklid latch mechanism to thereby secure release, wherein this pictorial representation is also suited to inform a small child of what to do to secure his/her release from the confined space of the trunk. In U.S. Pat. No. 7,029,238 B2, the trunk emergency release handle is composed of a luminous material, as for example a phosphorescent material, wherein the pictorial representation is provided in the form of iconic holes in the material.

A problem of the conventional trunk emergency release handle used for trunk extrication is that the luminous material thereof is costly. Accordingly, a benefit can be realized if the luminous material can somehow be minimized with respect to the over-all structure of the trunk emergency release handle.

SUMMARY OF THE INVENTION

The present invention pertains to an automobile having a trunk forming an interior space selectively enclosable by a hinged decklid, wherein the decklid is pivotable between an open position and a closed position, wherein a decklid latch mechanism selectively locks the decklid at its closed position, and wherein the decklid latch mechanism includes a trunk emergency release handle connected thereto by a cable linkage whereby pulling thereupon actuates the decklid latch mechanism so as to unlock the decklid and thereby provide extrication from the trunk.

The present invention is a trunk emergency release handle composed of an exterior shell of generally opaque plastic material having an instructional pictorial representation in the form of iconic holes. The pictorial representation is, for example, that of an automobile with an open trunk, a caricature of a person in an exiting mode of movement, and an arrow showing how to pull on the trunk emergency release handle to operate the decklid latch mechanism to thereby secure release, wherein the pictorial representation is suitable to inform a small child of what to do to secure his/her release from the confined space of the trunk. In a most preferred form of the present invention, a slot is provided within the exterior shell which is at least co-extensive with the iconic holes, and a luminous insert composed of a luminous or luminescent (i.e., phosphorescent) "glow-in-the-dark" material (well known in the art) is configured to be inserted into the slot so as to be located at the iconic holes and thereby provide illumination of the iconic holes. In a second preferred form of the present invention, the luminous material is co-molded with the opaque plastic in a two-shot injection molding process.

Accordingly, it is an object of the present invention to provide a trunk emergency release handle used for trunk extrication, wherein the amount of luminous material is minimized with respect to the over-all structure of the trunk emergency release handle.

This and additional objects, features and advantages of the present invention will become clearer from the following specification of a preferred embodiment.

DESCRIPTION OF THE PREFERRED EMBODIMENT

Figure 8:
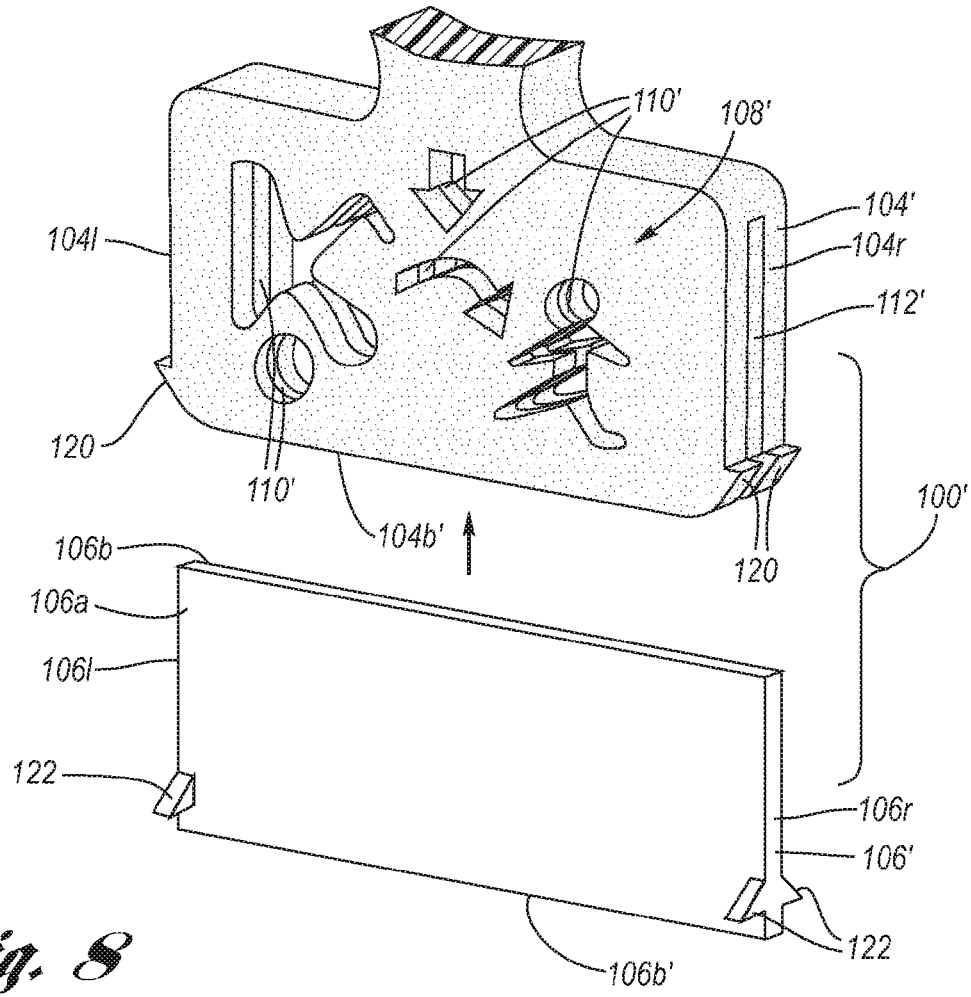
FIG. 8 is an exploded, partly sectional perspective view of a first embodiment of the trunk emergency release handle according to a second preferred aspect thereof
Figure 9:
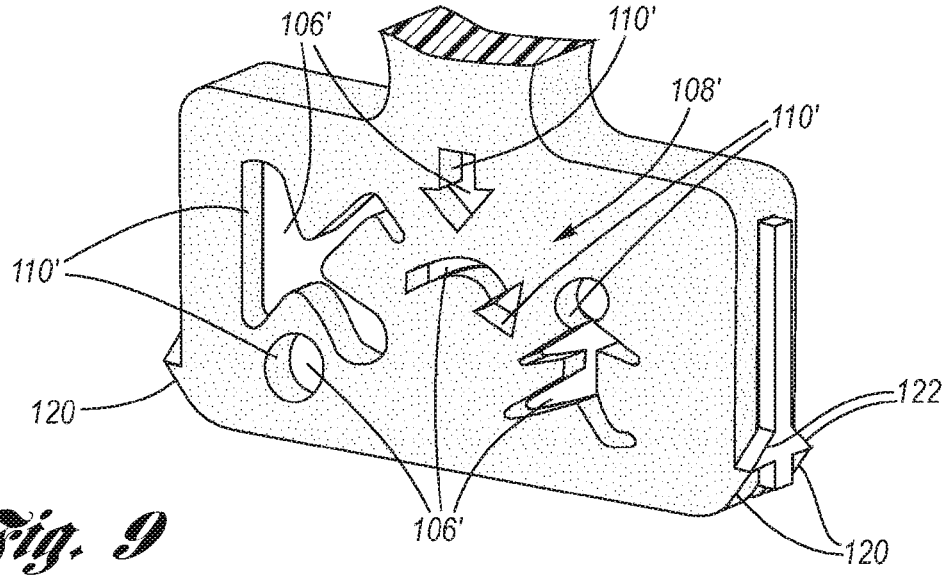
FIG. 9 is a detail perspective view of the first embodiment of the trunk emergency release handle according to the second preferred aspect thereof.
Figure 10:
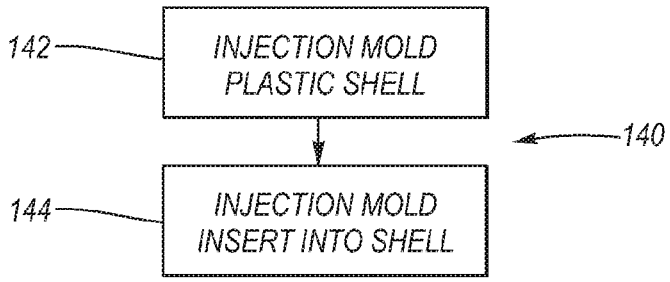
FIG. 10 is a flow chart for making the trunk emergency release handle according to a second embodiment of the present invention.
Figure 11:
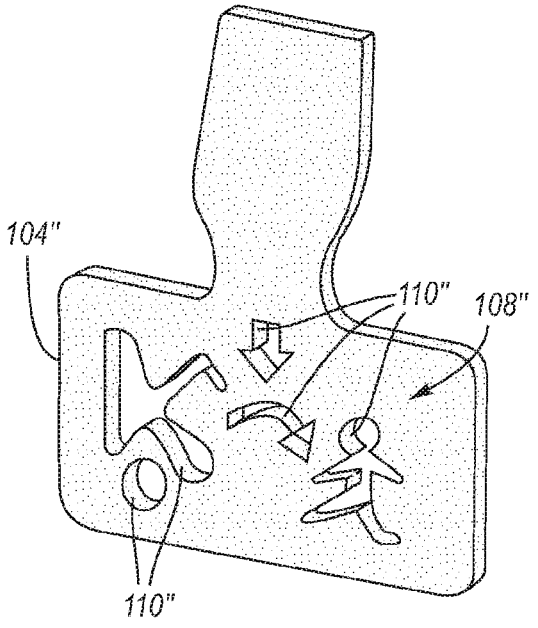
FIG. 11 is a perspective view of a trunk emergency release handle at a mid-stage of production according to the second embodiment of the present invention.
Figure 12:
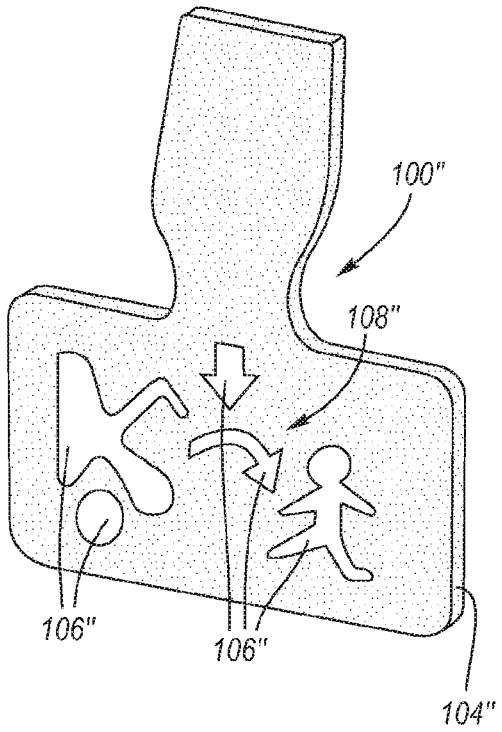
FIG. 12 is a perspective view of the trunk emergency release handle according to the second embodiment of the present invention.

Referring now to the Drawing, FIGS. 2 through 9 depict first and second aspects of a first preferred embodiment of the trunk emergency release handle according to present invention, while FIGS. 10 through 12 depict a second preferred embodiment of the trunk emergency release handle according to the present invention.

Figure 1A:
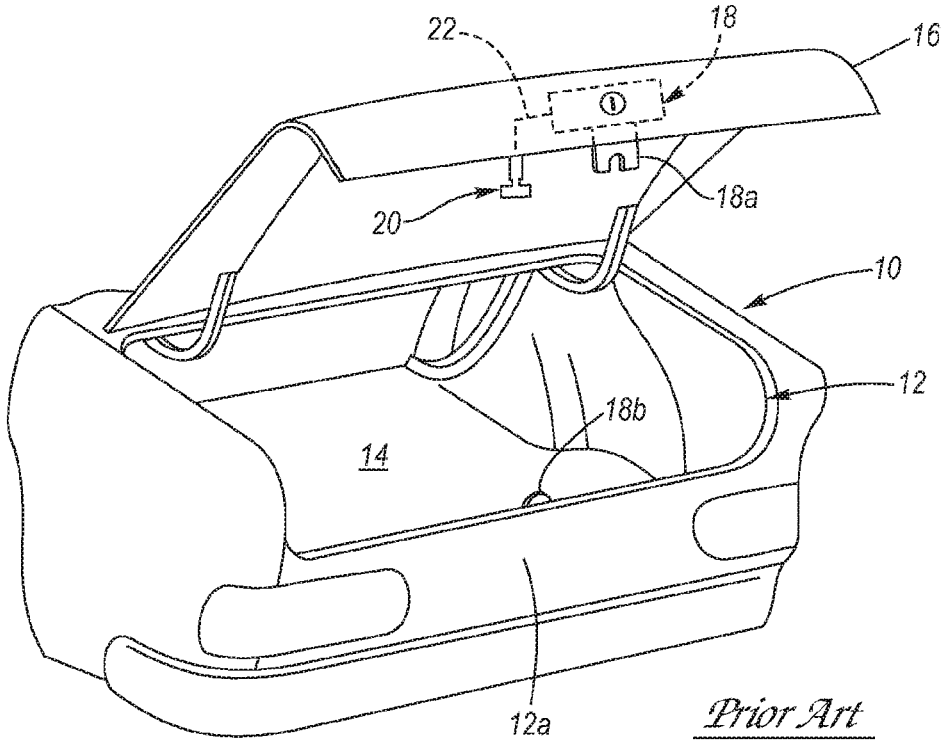
Prior Art Fig. 1A
FIG. 1A is a broken-away perspective view of an automobile equipped with a prior art trunk emergency trunk release handle interfaced with the decklid latch mechanism.
Figure 1B:
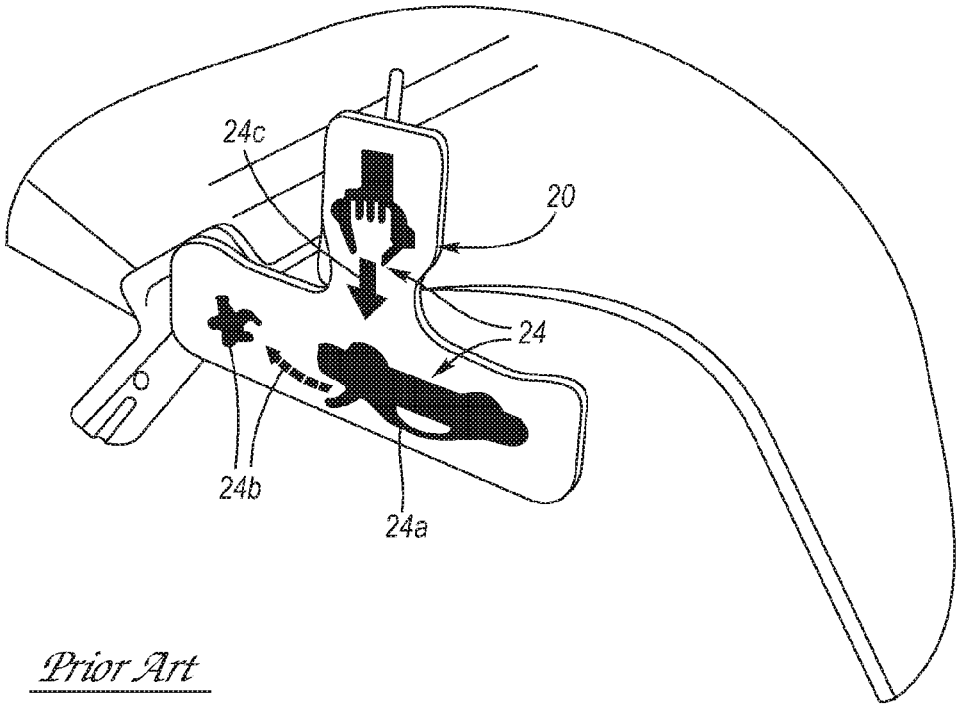
Prior Art Fig. 1B
FIG. 1B is a detail perspective view of the prior art trunk emergency release handle of FIG. 1A.
Figure 2:
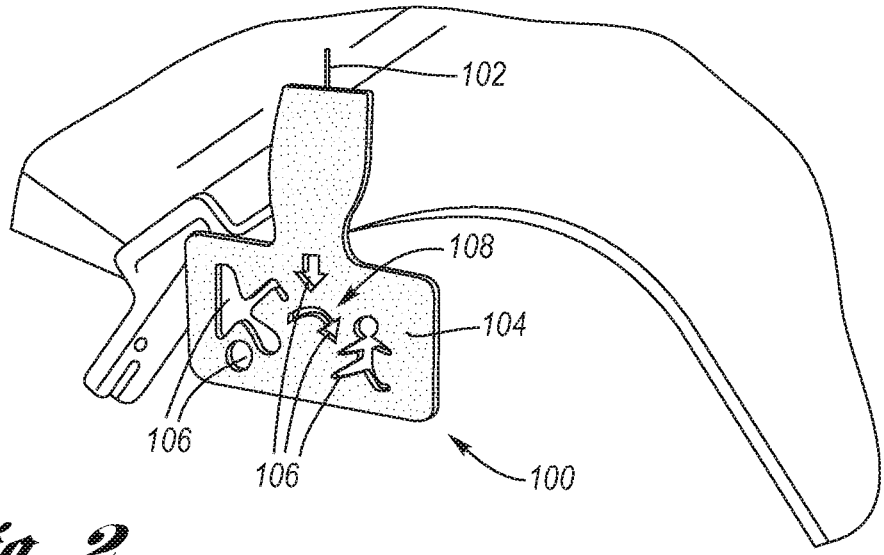
FIG. 2 is a detail perspective view of a trunk emergency release handle according to the present invention.

At FIG. 2, a trunk emergency release handle 100 is shown in operation with respect to a cable linkage 102 which interconnects with a conventional decklid latch mechanism as is for example well known in the art, as exemplified by U.S. Pat. Nos. 6,394,511 B1 and 6,369,395 B1, the disclosures of which are hereby incorporated herein by reference. The trunk emergency release handle 100 has a general T-shape and is composed of two parts, an opaque exterior shell 104 and a luminous insert 106.

The external shell 104 is composed of a plastic material, as for example a relatively inexpensive opaque plastic material, preferably a black polypropelene. The external shell 104 has formed therein a pictorial representation 108 composed of a related collection of iconic holes 110, having coordinated shapes whereby conveyed to an onlooker is information regarding the purpose and use of the emergency release handle, preferably comprehendible to a young child. As best shown at FIG. 4, the pictorial representation 108 is, by way merely of example, composed of an automobile with an open trunk 108*a*, a caricature of a person shown in an exiting mode of movement 108*b*, and an arrow 108*c* showing how to pull on the emergency release handle 100 to operate the decklid latch mechanism to thereby secure release. A planar slot 112 (shown best at FIG. 3) is formed within the external shell, the plane of the slot being parallel to the plane of the front and rear faces 100*a*, 100*b*. The iconic holes 110 are located at the front face 100*a* and intersect with the slot 112, wherein the iconic holes may further pass to the rear face 100*b* (that is pass from the front face to the rear face, intersecting the slot in so passing therebetween).

The luminous insert 106 is composed of a luminescent material, as for a preferred example a phosphorescent plastic. The luminous insert 106 is planar and configured so as to fit within the slot 112, whereby the luminous insert is coextensively located at least at each of the iconic holes 110 which compose the pictorial representation 108. Accordingly, the luminescence provided by the luminous insert illuminates the iconic holes 110 and thereby makes ready apprehension and comprehension of the pictorial representation 108 to a person within the dark interior space of the trunk when the decklid is locked closed.

Figure 3:
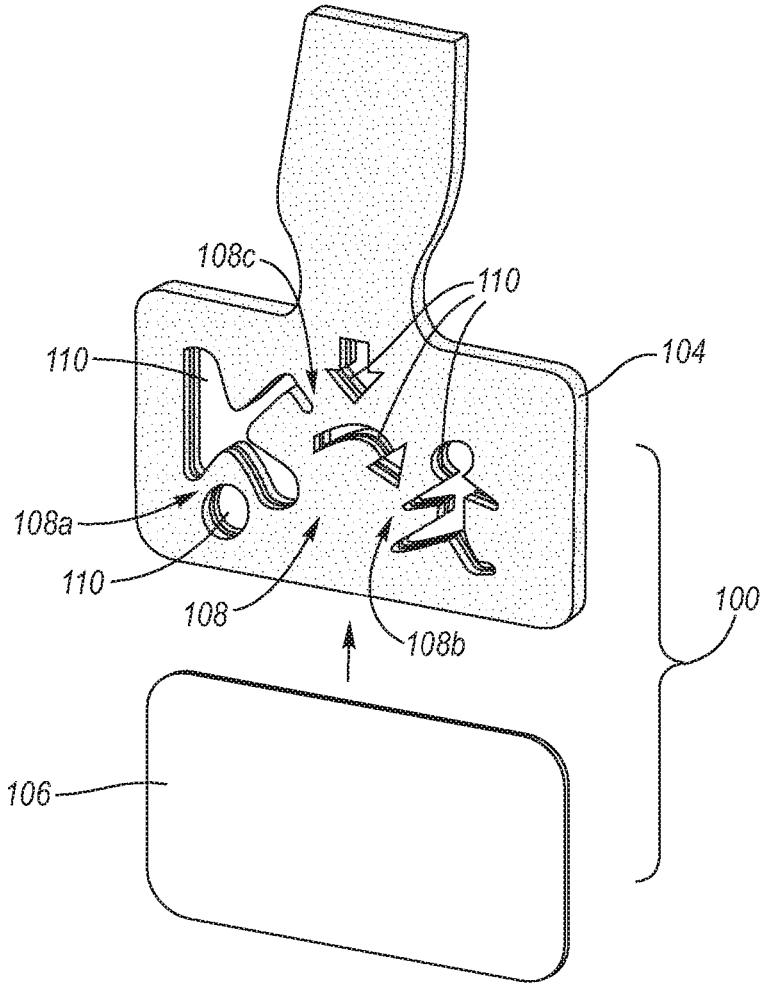
FIG. 3 is an exploded, perspective view of a first embodiment of the trunk emergency release handle, as in FIG. 2, according to a first preferred aspect thereof.
Figure 4:
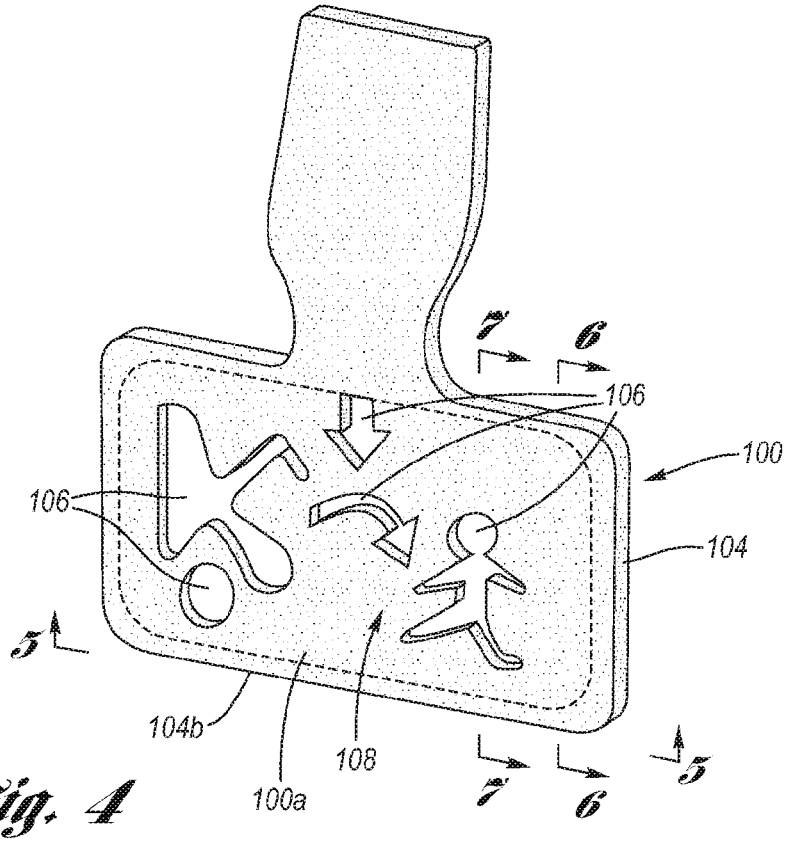
FIG. 4 is a detail perspective view of the first embodiment of the trunk emergency release handle, as in FIG. 2, according to the first preferred aspect thereof.
Figure 5:
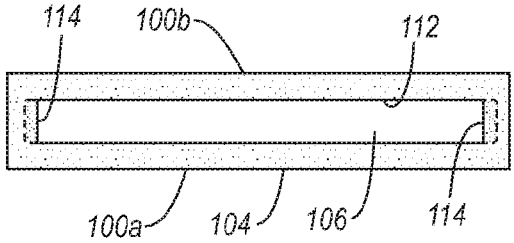
FIG. 5 is a bottom view of the first embodiment of the trunk emergency release handle, seen along line 5-5 of FIG. 4.
Figure 7:
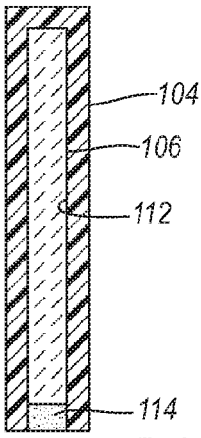
FIG. 7 is a sectional view of the first embodiment of the trunk emergency release handle, seen along line 7-7 of FIG. 4.
Figure 6:
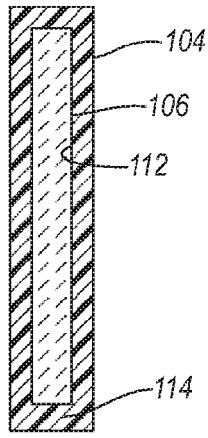
FIG. 6 is a sectional view of the first embodiment of the trunk emergency release handle, seen along line 6-6 of FIG. 4.

As shown at FIG. 3, the luminous insert 106 is inserted into the slot 112 via the slot extending to the bottom edge 104*b* of the exterior shell (see additionally FIG. 5). In order to retain the luminous insert 106 within the slot 112, a pair of nibs 114 are provided at each end of the slot (see FIGS. 5 and 6), wherein the luminous insert is press-fit past the nibs when being inserted into the slot.

The manner in which the luminous insert is interfaced with the slot can be in any manner suitable to the purpose at hand. In this regard, FIGS. 8 and 9 depict a second aspect of the trunk emergency release handle 100' in which the slot 112' now extends from the bottom edge 104*b* and along both the left and right edges 104*l*, 104*r*, and wherein a ramped abutment 120 is formed in the left and right edges adjacent the bottom edge. A pictorial representation 108' is provided via a cooperative collection of iconic holes 110' in the manner already detailed with respect to FIGS. 2 through 7. The luminous insert 106' now includes ramped bosses 122 at each face 106*a*, 106*b* at the left and right edges 106*l*, 106*r* adjacent the bottom edge 106*b*'. It will be understood that, as shown at FIG. 8, the luminous insert 106' is slid into the slot 112', whereby the ramped bosses pass over the ramped abutments and thereupon trap the luminous insert in the slot, as shown at FIG. 9. Now, as previously described, the luminous insert illuminates the iconic holes to provide apprehension and comprehension to an onlooker.

Turning attention now to FIGS. 10 through 12, another method of making an emergency release handle 100" according to the present invention is depicted, wherein FIG. 10 is a flow chart 140 which indicates the steps according to which the emergency release handle 100" is made.

At execution Block 142 of FIG. 10, a mold has been fabricated and interconnected conventionally with a plastic injection molding apparatus. The plastic injection molding apparatus inserts a first tool into the mold thereof and thereupon injects a first shot of plastic into the mold, as for example a relatively inexpensive opaque plastic, such as black polypropylene. The end result of this molding process is shown at FIG. 11, wherein an exterior shell 104" is provided having formed therein a pictorial representation 108" composed of a coordinated collection of iconic holes 110".

At execution Block 144 of FIG. 10, the mold is reconfigured via the injection molding apparatus inserting a second tooling into the mold accompanied by either the first tooling remaining or being previously removed all or in part in a manner known in the injection molding arts, so that a co-mold process can next transpire. The plastic injection molding apparatus next injects a second shot of luminescent plastic, as for example a phosphorescent plastic, into the mold. During this process the luminescent plastic fills the iconic holes 110" as a luminous insert 106" to provide the finished emergency release handle 100" shown at FIG. 12, wherein the luminescent plastic illuminates the iconic holes in an apprehensible and comprehensible manner to an onlooker, as described hereinabove.

It should be noted that a slot can be provided in the external shell, but to minimize the presence of the luminescent insert, the luminous inserting is preferably confined to only the iconic holes. Additionally, the iconic holes need not pass entirely through the exterior shell, wherein they may be depressions formed in the front face, or in the front and rear faces, of the exterior shell.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A trunk emergency release handle, comprising:

an exterior shell having formed therein a pictorial representation comprising a plurality of iconic holes, said exterior shell comprising:

a substantially planar front face whereat said plurality of iconic holes are located, and a rear face connected with said front face, wherein said exterior shell has formed therein a slot disposed between said front and rear faces, said slot being oriented generally parallel to said front face and extending at least coextensively with said plurality of iconic holes, said plurality of iconic holes intersecting said slot; and a luminous material disposed retainingly in said slot, said luminous material being at least coextensive with said plurality of iconic holes;

wherein said luminous material provides luminosity at said plurality of iconic holes.

2. The trunk emergency release handle of claim 1, wherein:

said exterior shell comprises an opaque plastic material; and said luminous material comprises a luminescent material exhibiting phosphorescence.

3. The trunk emergency release handle of claim 2, wherein said opaque plastic material comprises polypropylene; and wherein said luminescent material comprises a phosphorescent plastic.

4. The trunk emergency release handle of claim 1, further comprising an interfering abutment between said exterior shell and said luminous insert which retains said luminous insert received in said slot.

5. The trunk emergency release handle of claim 4, wherein said exterior shell comprises an opaque plastic material; and wherein said luminescent material comprises a phosphorescent plastic.

6. The trunk emergency release handle of claim 1, wherein the pictorial representation comprises the iconic holes each having mutually coordinated shapes which convey to an onlooker predetermined information comprising use and purpose of said handle.

7. The trunk emergency release handle of claim 6, wherein:

said exterior shell comprises an opaque plastic material; and said luminous material comprises a luminescent material exhibiting phosphorescence.

8. The trunk emergency release handle of claim 7, wherein said opaque plastic material comprises polypropylene; and wherein said luminescent material comprises a phosphorescent plastic.

9. The trunk emergency release handle of claim 7, further comprising an interfering abutment between said exterior shell and said luminous insert which retains said luminous insert received in said slot.

10. The trunk emergency release handle of claim 9, wherein said opaque plastic material comprises polypropylene; and wherein said luminescent material comprises a phosphorescent plastic.

11. The trunk emergency release handle of claim 1, wherein:

said exterior shell comprises a molded opaque plastic material; and said luminous material comprises a co-molded luminescent plastic material.

12. The trunk emergency release handle of claim 11, wherein the pictorial representation comprises the iconic holes each having mutually coordinated shapes which convey to an onlooker predetermined information comprising use and purpose of said handle.

13. The trunk emergency release handle of claim 11, wherein said opaque plastic material comprises polypropylene; and wherein said luminescent plastic material comprises a phosphorescent plastic.

14. The trunk emergency release handle of claim 13, wherein said exterior shell has a planar front face whereat said plurality of iconic holes are located.

15. The trunk emergency release handle of claim 14, wherein the pictorial representation comprises the iconic holes each having mutually coordinated shapes which convey to an onlooker predetermined information comprising use and purpose of said handle.

* * * * *